US009008539B2

(12) United States Patent
Takai

(10) Patent No.: US 9,008,539 B2
(45) Date of Patent: Apr. 14, 2015

(54) CLEANING DEVICE

(71) Applicant: Konica Minolta, Inc., Tokyo (JP)

(72) Inventor: Takayuki Takai, Anjo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/946,727

(22) Filed: Jul. 19, 2013

(65) Prior Publication Data

US 2014/0023393 A1 Jan. 23, 2014

(30) Foreign Application Priority Data

Jul. 20, 2012 (JP) ..... 2012-161625

(51) Int. Cl.
*G03G 15/16* (2006.01)
*G03G 21/00* (2006.01)

(52) U.S. Cl.
CPC ..... *G03G 21/0035* (2013.01); *G03G 15/161* (2013.01); *G03G 15/168* (2013.01)

(58) Field of Classification Search
CPC ..... G03G 21/0035
USPC ..... 399/71, 101, 353, 354
See application file for complete search history.

(56) References Cited

U.S. PATENT DOCUMENTS

| | | | | |
|---|---|---|---|---|
| 4,819,026 | A | 4/1989 | Lange et al. | |
| 5,031,000 | A * | 7/1991 | Pozniakas et al. | 399/349 |
| 5,233,398 | A * | 8/1993 | Nimura et al. | 399/354 |
| 5,481,351 | A | 1/1996 | Kawai et al. | |
| 2008/0101834 | A1 * | 5/2008 | Iwasaki | 399/357 |
| 2011/0103822 | A1 * | 5/2011 | Sugiura et al. | 399/101 |

FOREIGN PATENT DOCUMENTS

| | | |
|---|---|---|
| JP | 1-195485 | 8/1989 |
| JP | 1-307772 | 12/1989 |
| JP | 4-335695 | 11/1992 |
| JP | 6-274074 | 9/1994 |
| JP | 09-114342 | 5/1997 |
| JP | 2003-5599 | 1/2003 |
| JP | 2006-189500 | 7/2006 |
| JP | 2007-147708 | 6/2007 |

OTHER PUBLICATIONS

English Translation, JP 2006189500, Iwasaki, Jul. 20, 2006.*
Japanese Office Action, Notification of Reasons for Rejection, Patent Application No. 2012-161625. Dispatch date: Nov. 25, 2014 and English translation thereof (total of 8 pages).

* cited by examiner

*Primary Examiner* — Ryan Walsh
(74) *Attorney, Agent, or Firm* — Lucas & Mercanti, LLP

(57) ABSTRACT

A cleaning device for cleaning a cleaning subject, having: a first cleaning member that rotates in a predetermined direction, thereby removing toner from the cleaning subject; a first collecting member that collects the toner removed by the first cleaning member; and a second collecting member that is positioned downstream from the first collecting member in the predetermined direction and collects the toner removed by the first cleaning member, in which, a potential difference of the first collecting member relative to the first cleaning member is opposite in polarity to a potential difference of the second collecting member relative to the first cleaning member, the first collecting member has a potential equal in polarity to that of the first cleaning member, and the potential of the first collecting member is greater in magnitude than the potential of the first cleaning member.

9 Claims, 9 Drawing Sheets

CLEANING DEVICE

This application is based on Japanese Patent Application No. 2012-161625 filed on Jul. 20, 2012, the content of which is incorporated herein by reference.

BACKGROUND OF THE INVENTION

1. Field of the Invention

The present invention relates to cleaning devices, more particularly to a cleaning device for use in an image forming apparatus for forming a toner image on a printing medium.

2. Description of Related Art

As an invention related to a conventional cleaning device, a multicolor image recording device described in, for example, Japanese Patent Laid-Open Publication No. 1989-307772 is known. FIG. 16 is a configuration diagram of the multicolor image recording device 500 described in Japanese Patent Laid-Open Publication No. 1989-307772.

The multicolor image recording device 500 includes a photoreceptor 502, a fur brush roller 504, and collection rollers 506 and 508. The fur brush roller 504 gathers toner remaining on the photoreceptor 502. The collection rollers 506 and 508 collect the toner gathered by the fur brush roller 504. The collection roller 508 is provided downstream from the collection roller 506 in a rotational direction of the fur brush roller 504, and has a higher voltage applied thereto compared to the collection roller 506. Thus, the amount of toner to be accumulated in the fur brush roller 504 can be significantly reduced.

However, in the multicolor image recording device 500 described in Japanese Patent Laid-Open Publication No. 1989-307772, toner that is oppositely charged between the fur brush roller 504 and the collection rollers 506 and 508 cannot be collected. More specifically, in the case where toner is positively charged, the fur brush roller 504 is kept at a negative potential level. Moreover, the collection rollers 506 and 508 are kept at lower negative potential levels than the fur brush roller 504. As a result, the toner moves from the fur brush roller 504 to the collection rollers 506 and 508.

However, in the case where the collection rollers 506 and 508 are kept at further lower negative potential levels in order to more efficiently collect toner, toner is negatively charged between the fur brush roller 504 and the collection rollers 506 and 508, resulting in oppositely charged toner. Such oppositely charged toner readheres to the photoreceptor 502 without being collected by the collection rollers 506 and 508. Readhesion of the oppositely charged toner to the photoreceptor 502 might cause some issues such as toner stains and toner image quality deterioration. Moreover, some of the oppositely charged toner might remain in the fur brush roller 504 to be accumulated therein, leading to reduced cleaning performance of the fur brush roller 504.

SUMMARY OF THE INVENTION

In an embodiment of the present invention, a cleaning device for cleaning a cleaning subject includes: a first cleaning member that rotates in a predetermined direction, thereby removing toner from the cleaning subject; a first collecting member that collects the toner removed by the first cleaning member; and a second collecting member that is positioned downstream from the first collecting member in the predetermined direction and collects the toner removed by the first cleaning member. A potential difference of the first collecting member relative to the first cleaning member is opposite in polarity to a potential difference of the second collecting member relative to the first cleaning member. The first collecting member has a potential equal in polarity to that of the first cleaning member. The potential of the first collecting member is greater in magnitude than the potential of the first cleaning member.

DETAILED DESCRIPTION OF THE PREFERRED EMBODIMENTS

Hereinafter, an image forming apparatus including a cleaning device according to an embodiment of the present invention will be described with reference to the drawings.

Configuration of Image Forming Apparatus

Figure 1:
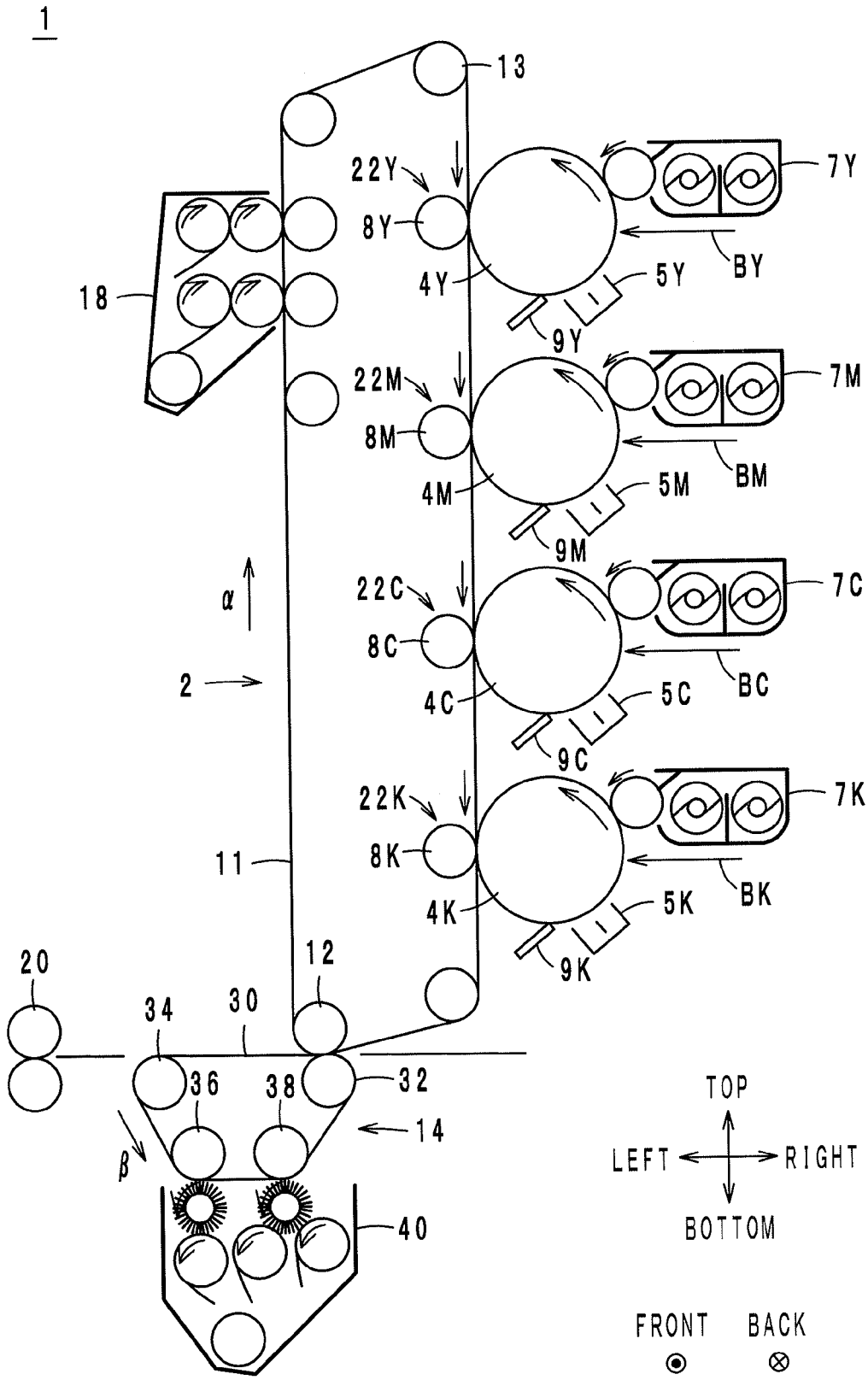
FIG. 1 is a diagram illustrating a substantial part (printing unit) of an image forming apparatus.

FIG. 1 is a diagram illustrating a substantial part (printing unit 2) of the image forming apparatus 1. The left-right direction, the front-back direction, and the top-bottom direction of the sheet of FIG. 1 will be simply referred to below as the left-right direction, the front-back direction, and the top-bottom direction, respectively. The front-back direction corresponds to a main scanning direction.

The image forming apparatus 1 is an electrophotographic color printer of a so-called tandem type adapted to synthesize images in the four colors yellow (Y), magenta (M), cyan (C), and black (K). The image forming apparatus 1 has the function of forming an image on a sheet of paper on the basis of image data read by a scanner, and includes the printing unit 2, as shown in FIG. 1. Note that in addition to the printing unit 2, the image forming apparatus 1 includes a paper feeding unit and other components, which are common features and therefore any descriptions thereof will be omitted.

The printing unit 2 is adapted to form toner images on a sheet of paper supplied from the paper feeding unit, and includes imaging units 22 (22Y, 22M, 22C, and 22K), an optical scanning device (not shown), transfer units 8 (8Y, 8M, 8C, and 8K), an intermediate transfer belt 11, a drive roller 12, a driven roller 13, a secondary transfer unit 14, and cleaning devices 18 and 40. Moreover, the imaging unit 22 (22Y, 22M, 22C, 22K) includes a photoreceptor drum 4 (4Y, 4M, 4C, 4K), a charger 5 (5Y, 5M, 5C, 5K), a developing device 7 (7Y, 7M, 7C, 7K), and a cleaner 9 (9Y, 9M, 9C, 9K).

The photoreceptor drum 4 (4Y, 4M, 4C, 4K) has a cylindrical shape extending in the front-back direction. The photoreceptor drum 4 is an image support to be rotated counterclockwise in FIG. 1. The charger 5 (5Y, 5M, 5C, 5K) negatively charges the circumferential surface of the photoreceptor drum 4 (4Y, 4M, 4C, 4K).

The optical scanning device under control of a control unit (not shown) optically scans a beam B (BY, BM, BC, BK) over the circumferential surface of the photoreceptor drum 4 (4Y, 4M, 4C, 4K). The potential of the surface where the beam B (BY, BM, BC, BK) is scanned approximates to 0V. As a result, an electrostatic latent image is formed on the circumferential surface of the photoreceptor drum 4 (4Y, 4M, 4C, 4K).

The developing device 7 (7Y, 7M, 7C, 7K) applies toner to the photoreceptor drum 4 (4Y, 4M, 4C, 4K), and develops a toner image based on the electrostatic latent image. More specifically, the developing device 7 (7Y, 7M, 7C, 7K) contains a developer consisting of toner and carrier, and the developer is stirred to negatively charge the toner while positively charging the carrier. The developing device 7 (7Y, 7M, 7C, 7K) applies the negatively charged toner to the photoreceptor drum 4 (4Y, 4M, 4C, 4K). As a result, the negatively charged toner adheres to the surface where the beam B (BY, BM, BC, BK) is scanned (i.e., where the potential is nearly 0V). Thus, a toner image is developed.

The intermediate transfer belt 11 is stretched between the drive roller 12 and the driven roller 13. The toner image developed on the photoreceptor drum 4 is subjected to primary transfer onto the intermediate transfer belt 11. The transfer unit 8 is disposed so as to face the inner circumferential surface of the intermediate transfer belt 11, and plays the role of subjecting the toner image formed on the photoreceptor drum 4 to primary transfer onto the intermediate transfer belt 11. Specifically, the transfer unit 8 is kept at a higher potential than the photoreceptor drum 4 (4Y, 4M, 4C, 4K). As a result, the negatively charged toner image is transferred from the photoreceptor drum 4 (4Y, 4M, 4C, 4K) onto the intermediate transfer belt 11.

The cleaner 9 collects toner that remains on the circumferential surface of the photoreceptor drum 4 after primary transfer. The drive roller 12 is rotated by an intermediate transfer belt driving unit (not shown in FIG. 1), thereby driving the intermediate transfer belt 11 in the direction of arrow a. As a result, the intermediate transfer belt 11 carries the toner image to the secondary transfer unit 14.

The secondary transfer unit 14 faces the drive roller 12 where the intermediate transfer belt 11 is wound, and has a belt 30 and rollers 32, 34, 36, and 38. The belt 30 is stretched around the rollers 32, 34, 36, and 38. The rollers 32, 34, 36, and 38 are, for example, aluminum rollers. The roller 32 is rotated by a belt driving unit (not shown in FIG. 1), thereby driving the belt 30 in the direction of arrow β (counterclockwise). Moreover, the roller 32 is kept at a higher potential than the intermediate transfer belt 11, so that the toner image supported on the intermediate transfer belt 11 is subjected to secondary transfer onto a sheet of paper passing between the intermediate transfer belt 11 and the belt 30. The cleaning device 18 removes toner that remains on the intermediate transfer belt 11 after secondary transfer of the toner image onto the sheet. The cleaning device 40 removes toner adhering to the cleaning subject, i.e., the belt 30.

A fusing device 20 performs heating and pressing on the sheet with the toner image subjected to secondary transfer. As a result, the toner image is fixed on the sheet. Thereafter, the sheet is outputted from the image forming apparatus 1.

Configuration of Cleaning Device

Figure 2:
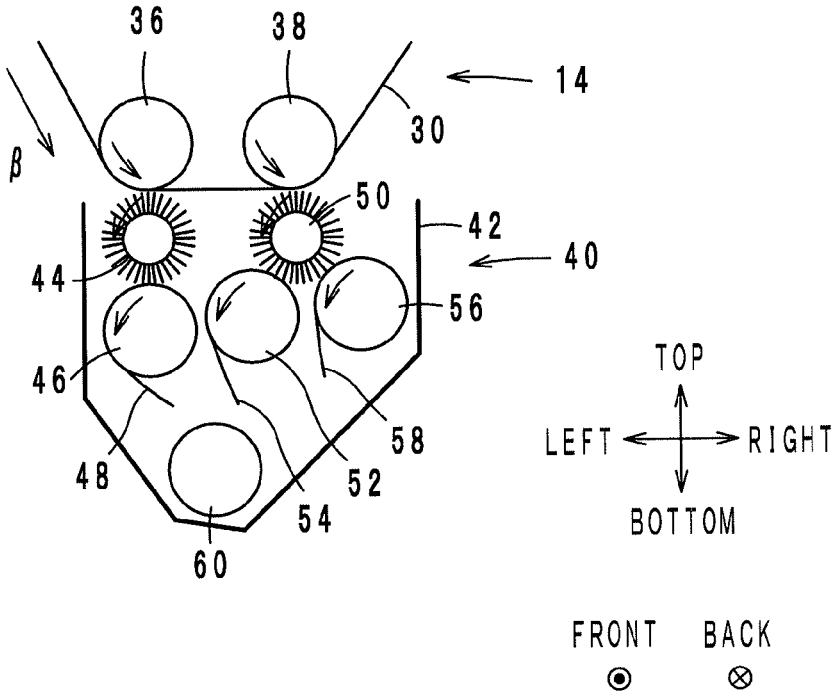
FIG. 2 is a configuration diagram of a cleaning device.
Figure 3:
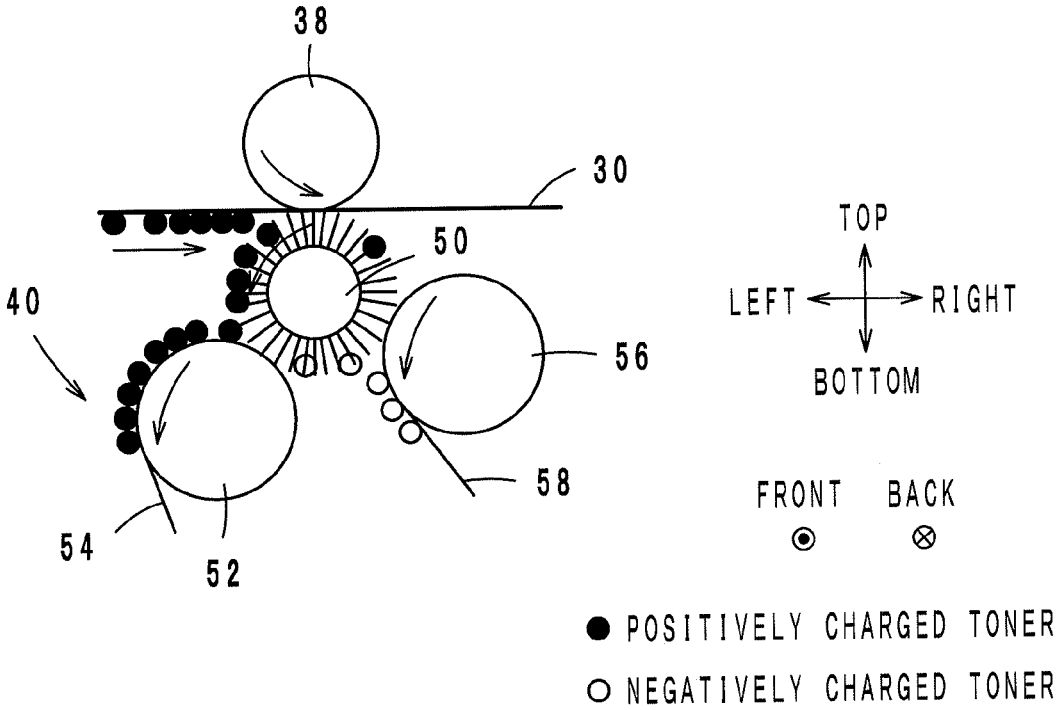
FIG. 3 is an enlarged view of a cleaning brush and its vicinity in the cleaning device.

Next, the configuration of the cleaning device 40 will be described with reference to the drawings. FIG. 2 is a configuration diagram of the cleaning device 40. FIG. 3 is an enlarged view of a cleaning brush 50 and its vicinity in the cleaning device 40.

The cleaning device 40 is adapted to collect the toner that has been transferred from the intermediate transfer belt 11 and adheres to the belt 30, and includes a housing 42, the cleaning brush 44, a cleaning brush 50, collecting rollers 46, 52, and 56, scrapers 48, 54, and 58, and a feed screw 60, as shown in FIG. 2.

The housing 42 is in the shape of a box with an opening at the top, and accommodates the cleaning brushes 44 and 50, the collecting rollers 46, 52, and 56, the scrapers 48, 54, and 58, and the feed screw 60.

The cleaning brush 44 (second cleaning member) is positioned upstream from the cleaning brush 50 in the moving direction (arrow β) of the belt 30, and removes toner from the belt 30, as shown in FIG. 2. More specifically, the cleaning brush 44 rotates counterclockwise while contacting the belt 30 on the upstream side from the cleaning brush 50 in the moving direction (arrow of the belt 30, as shown in FIG. 2. The belt 30 bites into the cleaning brush 44. The term "bite" is intended to mean that the minimum distance from the center of the cleaning brush 44 to the belt 30 is shorter than the radius of the cleaning brush 44. Moreover, the cleaning brush 44 is opposed to the roller 36, which is kept at a ground potential, with respect to the belt 30. The cleaning brush 44 is kept at a positive potential V1, which is higher than a potential V0 (ground potential) of the belt 30, through voltage application by an unillustrated power source. Therefore, negatively charged toner adhering to the belt 30 is removed by the cleaning brush 44. However, there is also positively charged toner on the belt 30. There is less toner that is positively charged than that is negatively charged. Such positively charged toner is carried on the belt 30 downstream in the moving direction without being removed by the cleaning brush 44.

For example, the cleaning brush 44 is made of a fibrous material provided with conductivity by dispersing carbons in resin such as nylon, polyester, acrylic, or rayon. The cleaning brush 44 has a fineness of from 1 denier [D] to 10 D, a fiber density of from 50 kilofilaments per square inch [kF/inch$^2$] to 300 kF/inch$^2$, and a resistance of from $10^5\Omega$ to $10^{13}\Omega$ per unit length of raw yarn.

The collecting roller 46 collects the negatively charged toner removed by the cleaning brush 44. More specifically, the collecting roller 46 rotates counterclockwise while contacting the bottom of the cleaning brush 44, as shown in FIG. 2. The collecting roller 46 bites into the cleaning brush 44. The collecting roller 46 is kept at a positive potential V2, which is higher than the potential V1 of the cleaning brush 44, through voltage application by an unillustrated power source. That is, the potential V2 of the collecting roller 46 and the potential V1 of the cleaning brush 44 are equal in polarity, and the potential V2 of the collecting roller 46 is greater in magnitude than the potential V1 of the cleaning brush 44. Thus, the negatively charged toner removed by the cleaning brush 44 is collected by the collecting roller 46. The collected negatively charged toner is separated from the circumferential surface of the collecting roller 46 by the scraper 48. As a result, the negatively charged toner is stored to the housing 42.

The collecting roller 46 is, for example, an aluminum roller. Moreover, the scraper 48 is made of a thin stainless steel plate having a thickness of, for example, 0.08 mm.

Incidentally, the potential V2 of the collecting roller 46 is kept at a positive potential level higher than the potential V1 of the cleaning brush 44. Accordingly, some of the negatively charged toner is changed into positively charged toner by discharge or charge injection, which occurs between the collecting roller 46 and the cleaning brush 44. Such positively charged toner is not collected from the cleaning brush 44 by the collecting roller 46. As a result, the positively charged toner on the cleaning brush 44 readheres to the belt 30, and carried on the belt 30 downstream in the moving direction.

The cleaning brush 50 (first cleaning member) is positioned downstream from the cleaning brush 44 in the moving direction (arrow β) of the belt 30, and removes toner from the belt 30, as shown in FIGS. 2 and 3. More specifically, the cleaning brush 50 rotates counterclockwise while contacting the belt 30 on the downstream side from the cleaning brush 44 in the moving direction (arrow β) of the belt 30, as shown in FIG. 2. The direction in which the cleaning brush 50 makes a rotation from the contact point with the belt 30 is defined herein as the "toner collecting direction". The belt 30 bites into the cleaning brush 50. Moreover, the amount of bite in the cleaning brush 50 by the belt 30 is approximately equal to the amount of bite in the cleaning brush 44 by the belt 30. In addition, the term "the amount of bite" herein is intended to mean the difference between the radius of the cleaning brush 44 or 50 and the minimum distance from the center of the cleaning brush 50 to the belt 30. Moreover, the cleaning brush 50 is opposed to the roller 38, which is kept at a ground potential, with respect to the belt 30. The cleaning brush 50 is kept at a negative potential V3, which is lower than a potential V0 (ground potential) of the belt 30, through voltage application by an unillustrated power source. Therefore, positively charged toner adhering to the belt 30 is removed by the cleaning brush 50.

For example, the cleaning brush 50 is made of a fibrous material provided with conductivity by dispersing carbons in resin such as nylon, polyester, acrylic, or rayon. The cleaning brush 50 has a fineness of from 1 denier [D] to 10 D, a fiber density of from 50 kilofilaments per square inch [kF/inch$^2$] to 300 kF/inch$^2$, and a resistance of from $10^5\Omega$ to $10^{13}\Omega$ per unit length of raw yarn.

The collecting roller 52 collects the positively charged toner removed by the cleaning brush 50, as shown in FIGS. 2 and 3. More specifically, the collecting roller 52 rotates counterclockwise while contacting the bottom left of the cleaning brush 50, as shown in FIG. 2. The collecting roller 52 bites into the cleaning brush 50. The collecting roller 52 is kept at a negative potential V4, which is lower than the potential V3 of the cleaning brush 50, through voltage application by an unillustrated power source. That is, the potential V4 of the collecting roller 52 and the potential V3 of the cleaning brush 50 are equal in polarity, and the potential V4 of the collecting roller 52 is greater in magnitude than the potential V3 of the cleaning brush 50. Thus, the positively charged toner removed by the cleaning brush 50 is collected by the collecting roller 52. The collected positively charged toner is separated from the circumferential surface of the collecting roller 52 by the scraper 54. As a result, the positively charged toner is stored to the housing 42.

The collecting roller 52 is, for example, an aluminum roller. Moreover, the scraper 54 is made of, for example, a thin stainless steel plate having a thickness of 0.08 mm.

Incidentally, the potential V4 of the collecting roller 52 is kept at a negative potential level lower than the potential V3 of the cleaning brush 50. Accordingly, some of the positively charged toner is changed into negatively charged toner by discharge or charge injection, which occurs between the collecting roller 52 and the cleaning brush 50. Such negatively charged toner is not collected from the cleaning brush 50 by the collecting roller 52. As a result, the negatively charged toner is carried on the cleaning brush 50 downstream in the toner collecting direction.

The collecting roller 56 is positioned downstream from the collecting roller 52 in the toner collecting direction, and collects the toner removed by the cleaning brush 50, as shown in FIGS. 2 and 3. More specifically, the collecting roller 56 rotates counterclockwise while contacting the bottom right of the cleaning brush 50, as shown in FIG. 2. The collecting roller 56 bites into the cleaning brush 50. The amount of bite in the cleaning brush 50 by the collection roller 52 is approximately equal to the amount of bite in the cleaning brush 50 by the collection roller 56. The collecting roller 56 is kept at a positive potential V5 through voltage application by an unillustrated power source. As a result, the potential difference of the collection roller 56 relative to the cleaning brush 50 (V5−V3) is opposite in polarity to the potential difference of the collection roller 52 relative to the cleaning brush 50 (V4−V3). Accordingly, the negatively charged toner adhering to the cleaning brush 50 is collected by the collection roller 56. Then, the collected negatively charged toner is separated from the circumferential surface of the collecting roller 56 by the scraper 58. As a result, the negatively charged toner is stored to the housing 42.

The collecting roller 56 is, for example, an aluminum roller. Moreover, the scraper 58 is made of a thin stainless steel plate having a thickness of, for example, 0.08 mm.

The feed screw 60 carries collected toner in the front-back direction.

Effects

The cleaning device 40 thus configured inhibits positively charged toner from readhering to the belt 30. More specifically, in the case of the multicolor image recording device 500 described in Japanese Patent Laid-Open Publication No. 1989-307772, when the collection rollers 506 and 508 are kept at lower negative potential levels than normal in order to more efficiently collect toner, toner is negatively charged between the fur brush roller 504 and the collection rollers 506 and 508, resulting in oppositely charged toner. Such oppositely charged toner readheres to the photoreceptor 502 without being collected by the collection rollers 506 and 508. Readhesion of the oppositely charged toner to the photoreceptor 502 might cause toner stains.

Therefore, in the cleaning device 40, both the potential V4 of the collection roller 52 and the potential V3 of the cleaning brush 50 are negative (i.e., they are equal in polarity). Moreover, the potential V4 of the collection roller 52 is higher in magnitude than the potential V3 of the cleaning brush 50. Accordingly, positively charged toner adhering to the cleaning brush 50 is collected by the collection roller 52. However, some of the positively charged toner is changed into negatively charged toner (i.e., oppositely charged toner) by discharge or charge injection, which occurs between the cleaning brush 50 and the collecting roller 52. Therefore, the collection roller 56 collects the toner removed by the cleaning brush 50, on the downstream side from the collection roller 52 in the toner collecting direction. Specifically, the potential difference of the collection roller 56 relative to the cleaning brush 50 (V5–V3) is opposite in polarity to the potential difference of the collection roller 52 relative to the cleaning brush 50 (V4–V3). Therefore, negatively charged toner is collected from the cleaning brush 50 by the collection roller 56. As a result, negatively charged toner on the cleaning brush 50 is inhibited from readhering to the belt 30. Thus, in the cleaning device 40, negatively charged toner adhering to the belt 30 is inhibited from adhering to the back of a sheet of paper, regardless of whether it is after adhesion to the intermediate transfer belt 11.

Note that only a small portion of the negatively charged toner is changed into positively charged toner by discharge which occurs between the cleaning brush 50 and the collecting roller 56. However, such positively charged toner passes between the belt 30 and the cleaning brush 50 while being held on the cleaning brush 50, and thereafter, the toner is collected by the collection roller 52. Therefore, positively charged toner hardly adheres to the belt 30.

Furthermore, in the cleaning device 40, negatively charged toner adhering to the cleaning brush 50 is collected by the collection roller 56. Therefore, toner accumulation in the cleaning brush 50 can be inhibited. Thus, the cleaning device 40 is resistant to degradation in cleaning performance even after long-term use of the image forming apparatus 1.

First Experiment

Figure 4:
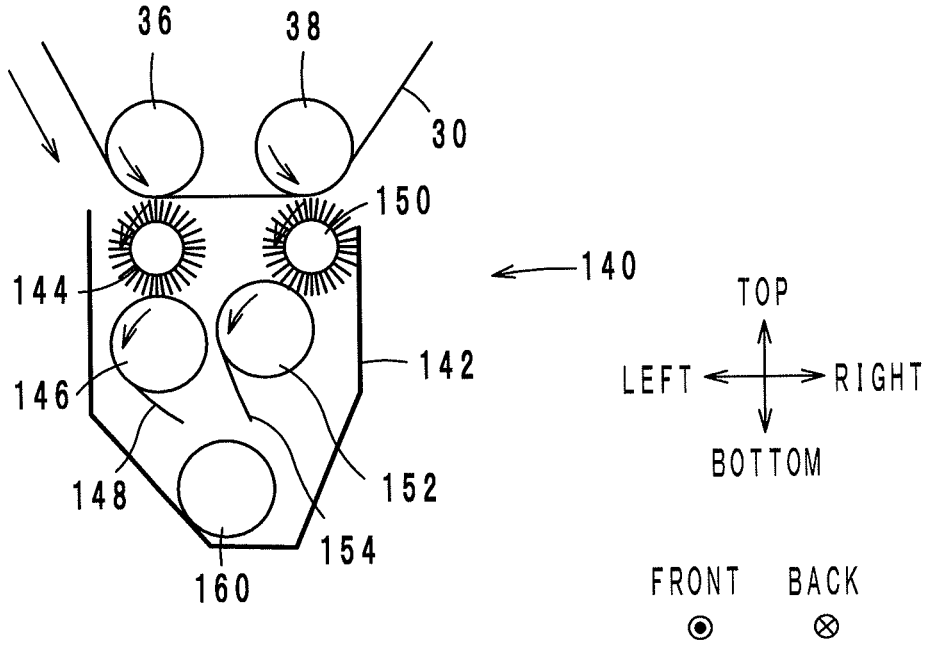
FIG. 4 is a diagram illustrating the configuration of a cleaning device according to a comparative example.

To clarify effects achieved by the cleaning device 40, the present inventors conducted a first experiment as will be described below. FIG. 4 is a diagram illustrating the configuration of a cleaning device 140 according to a comparative example.

The present inventors prepared a first example with the configuration shown in FIG. 2 and the comparative example shown in FIG. 4. Elements of the cleaning device 140 according to the comparative example that are the same as those of the cleaning device 40 are denoted by reference numbers obtained by adding 100 to the reference numbers for the cleaning device 40. The cleaning device 140 differs from the cleaning device 40 in that it is not equipped with the collection roller 56 and the scraper 58.

Conditions for the first example and the comparative example will be described below.

Conditions for the first example:

Potential V1 of cleaning brush 44: 200V;

Potential V2 of collection roller 46: 800V;

Potential V3 of cleaning brush 50: −200V;

Potential V4 of collection roller 52: −800V;

Potential V5 of collection roller 56: 400V.

Conditions for the comparative example:

Potential V1 of cleaning brush 144: 200V;

Potential V2 of collection roller 146: 800V,

Potential V3 of cleaning brush 150: −200V;

Potential V4 of collection roller 152: −800V.

Common conditions for the first example and the comparative example:

Sheet feed speed: 500 mm/sec;

Circumferential speed of cleaning brush 44: 250 mm/sec;

Circumferential speed of collection roller 46: 400 mm/sec;

Amount of bite in cleaning brushes 44, 50, 144, and 150 by belt 30: 1.4 mm;

Amount of bite in cleaning brushes 44 and 144 by collection rollers 46 and 146: 1.4 mm;

Amount of bite in cleaning brushes 44 and 144 by collection rollers 52, 56, and 152: 1.4 mm;

Toner: negatively charged toner obtained by treating 100 parts by weight of a toner base material, produced by wet granulation and having a mean volume diameter of about 6.5 μm, with an additive containing 0.2 parts by weight of a first hydrophobic silica, 0.5 parts by weight of a second hydrophobic silica, and 0.5 parts by weight of a hydrophobic titanium oxide;

Sheet: coated paper with smooth surface and high transferability.

Figure 5:
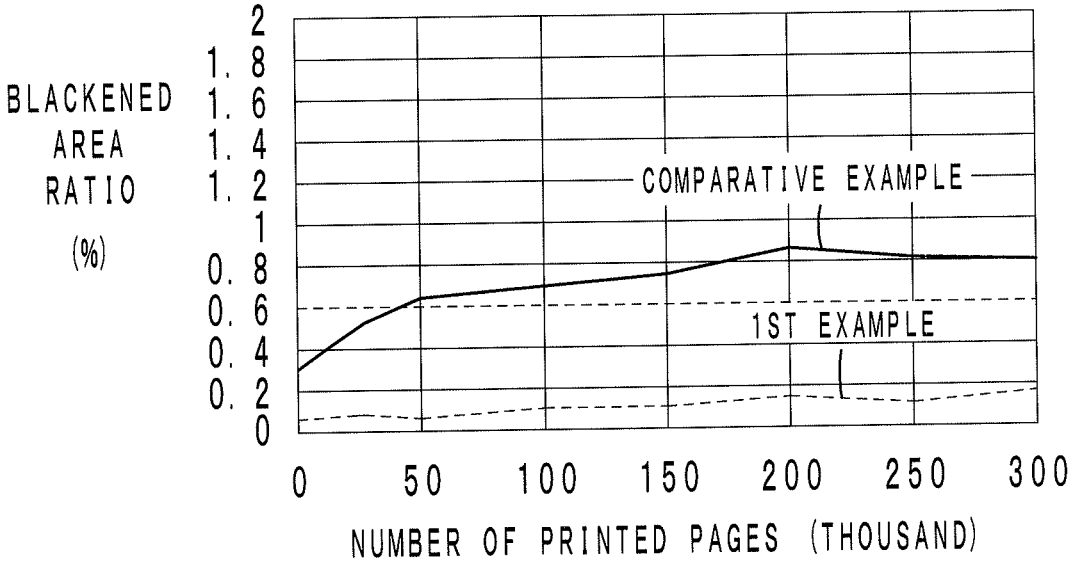
FIG. 5 is a graph showing the result of an experiment.

In each of the first example and the comparative example, a stabilizing toner patch formed on the intermediate transfer belt 11 between every two sheets was transferred onto the belt 30 through application of a secondary transfer voltage, and the stabilizing toner patch was collected by the cleaning device 40. In this case, 98% of the toner in the stabilizing patch on the intermediate transfer belt 11 moved to the belt 30. The stabilizing patch was formed between every two sheets, sequentially in one of the four colors: Y, M, C, and K. For each color, the amount of adhering toner in the stabilizing patch was 5 g/m$^2$. For each color, the stabilizing patch was a solid image having a maximum axial width and a length of 21 mm (5% of the length of an A3 size image) in the sheet feeding direction. Toner stains on the back of 300,000 printed sheets were inspected. The inspection of the toner stains on the back of the sheets was conducted by measuring the ratio of a blackened area to the back of each sheet. Specifically, the blackened area ratio is the percentage of a black area that occupies the back of a sheet in a captured image binarized by image processing. FIG. 5 is a graph showing the result of the experiment. The vertical axis represents the blackened area ratio, and the horizontal axis represents the number of printed pages.

For the comparative example, it can be appreciated from FIG. 5 that the blackened area ratio increased as the number of printed pages increased. In general, a sheet with a blackened area ratio higher than 0.6% is considered as having considerable stains on its back. Moreover, for the comparative example, the blackened area ratio increased to about 0.8%. Accordingly, for the comparative example, it can be appreciated that the sheets had considerable stains on their back.

On the other hand, for the first example, the blackened area ratio did not exceed 0.2% as the number of printed pages increased, as shown in FIG. 5. Accordingly, for the first example, it can be appreciated that considerable image noise did not occur. Thus, it can be appreciated that the cleaning device 40 inhibited oppositely charged toner from readhering to the belt 30.

First Modification

Figure 6:
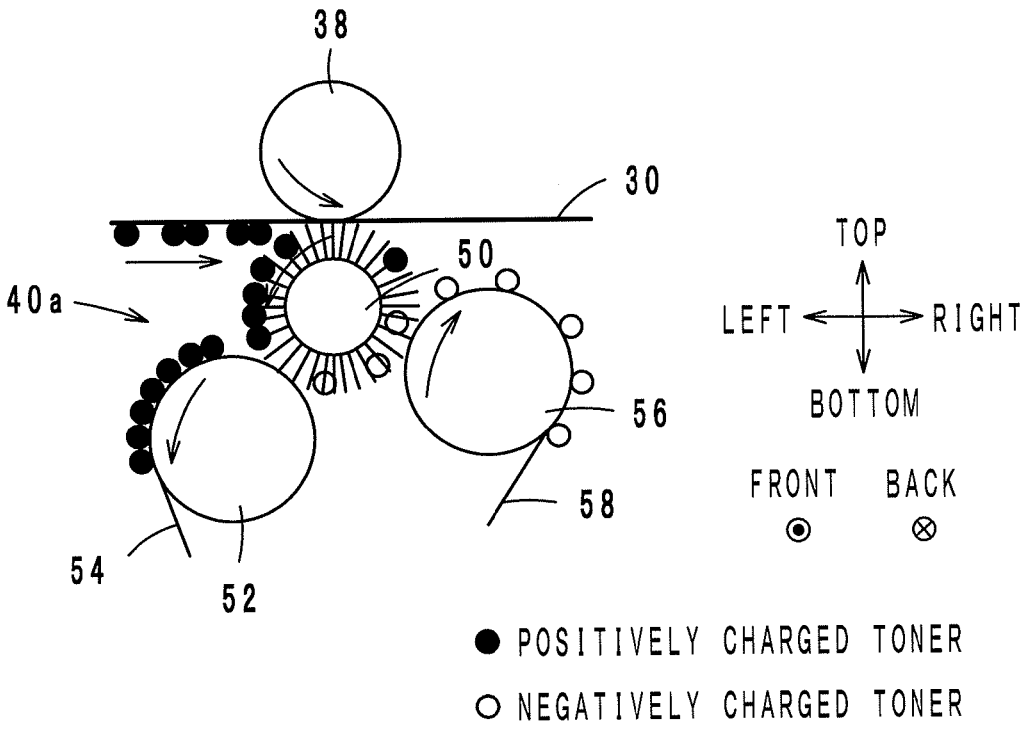
FIG. 6 is an enlarged view of a cleaning brush and its vicinity in a cleaning device according to a first modification.

A cleaning device 40*a* according to a first modification will be described below with reference to the drawings. FIG. 6 is an enlarged view of the cleaning brush 50 and its vicinity in the cleaning device 40*a* according to the first modification.

The cleaning device 40*a* differs from the cleaning device 40 in terms of the rotational direction of the collection roller 56 and the position where the scraper 58 contacts the collection roller 56. In the cleaning device 40*a*, the collection roller 56 rotates clockwise, and the scraper 58 contacts the bottom right of the collection roller 56, thereby separating toner from the circumferential surface of the collection roller 56.

Although the collection roller 56 rotates clockwise as shown in FIG. 6, the cleaning device 40*a* can achieve effects similar to those achieved by the cleaning device 40.

Second Modification

Figure 7:
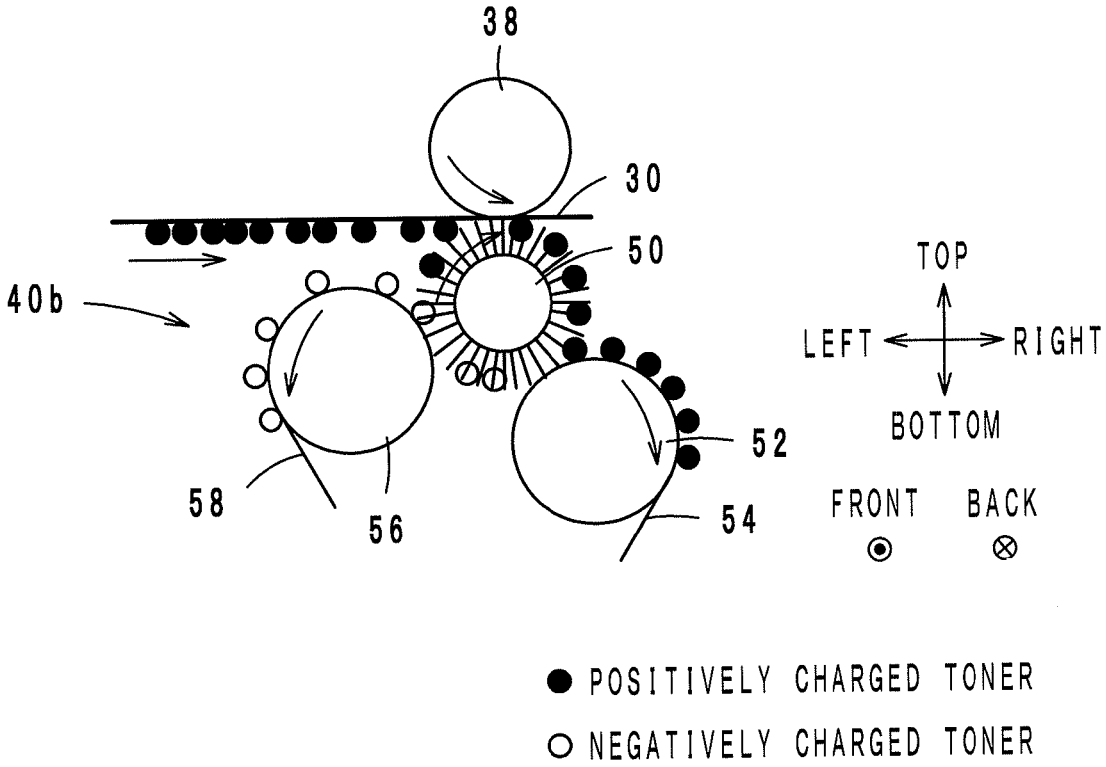
FIG. 7 is an enlarged view of a cleaning brush and its vicinity in a cleaning device according to a second modification.

A cleaning device 40*b* according to a second modification will be described below with reference to the drawings. FIG. 7 is an enlarged view of the cleaning brush 50 and its vicinity in the cleaning device 40*b* according to the second modification.

The cleaning device 40*b* differs from the cleaning device 40 in terms of the rotational directions of the cleaning brush 50 and the collection roller 52, the positions of the collection rollers 52 and 56, the positions of the scrapers 54 and 58, and the positions where the scrapers 54 and 58 contact the collection rollers 52 and 56. In the cleaning device 40*b*, the cleaning brush 50 and the collection roller 52 rotate clockwise. The collection roller 52 is provided to the bottom right of the cleaning brush 50, and the collection roller 56 is provided to the bottom left of the cleaning brush 50 (on the downstream side from the collection roller 52 in the toner collecting direction). The scraper 54 contacts the bottom right of the collection roller 52.

Although the cleaning brush 50 and the collection roller 52 rotate clockwise as shown in FIG. 7, the cleaning device 40*b* can achieve effects similar to those achieved by the cleaning device 40.

Third Modification

Figure 8:
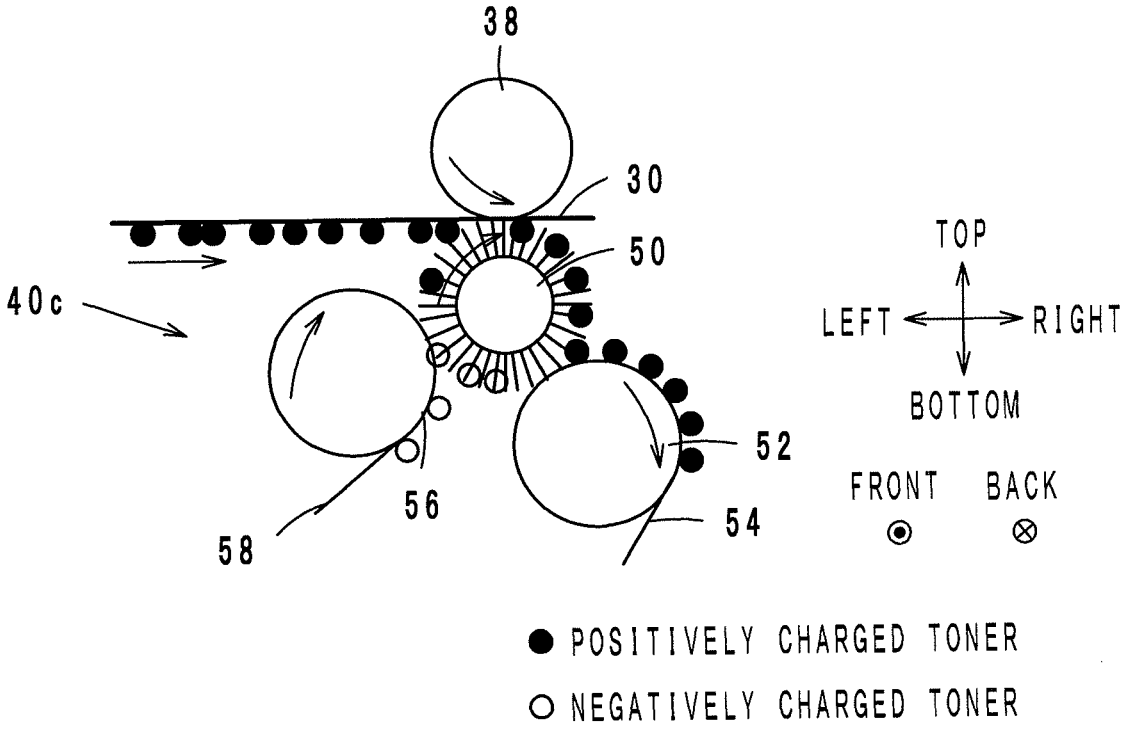
FIG. 8 is an enlarged view of a cleaning brush and its vicinity in a cleaning device according to a third modification.

A cleaning device 40*c* according to a third modification will be described below with reference to the drawings. FIG. 8 is an enlarged view of the cleaning brush 50 and its vicinity in the cleaning device 40*c* according to the third modification.

The cleaning device 40*c* differs from the cleaning device 40 in terms of the rotational directions of the cleaning brush 50 and the collection rollers 52 and 56, the positions of the collection rollers 52 and 56, the positions of the scrapers 54 and 58, and the positions where the scrapers 54 and 58 contact the collection rollers 52 and 56. In the cleaning device 40*c*, the cleaning brush 50 and the collection rollers 52 and 56 rotate clockwise. The collection roller 52 is provided to the bottom right of the cleaning brush 50, and the collection roller 56 is provided to the bottom left of the cleaning brush 50 (on the downstream side from the collection roller 52 in the toner collecting direction). The scraper 54 contacts the bottom right of the collection roller 52, and the scraper 58 contacts the bottom right of the collection roller 56.

Although the cleaning brush 50 and the collection rollers 52 and 56 rotate clockwise as shown in FIG. 8, the cleaning device 40*c* can achieve effects similar to those achieved by the cleaning device 40.

Fourth Modification

Figure 9:
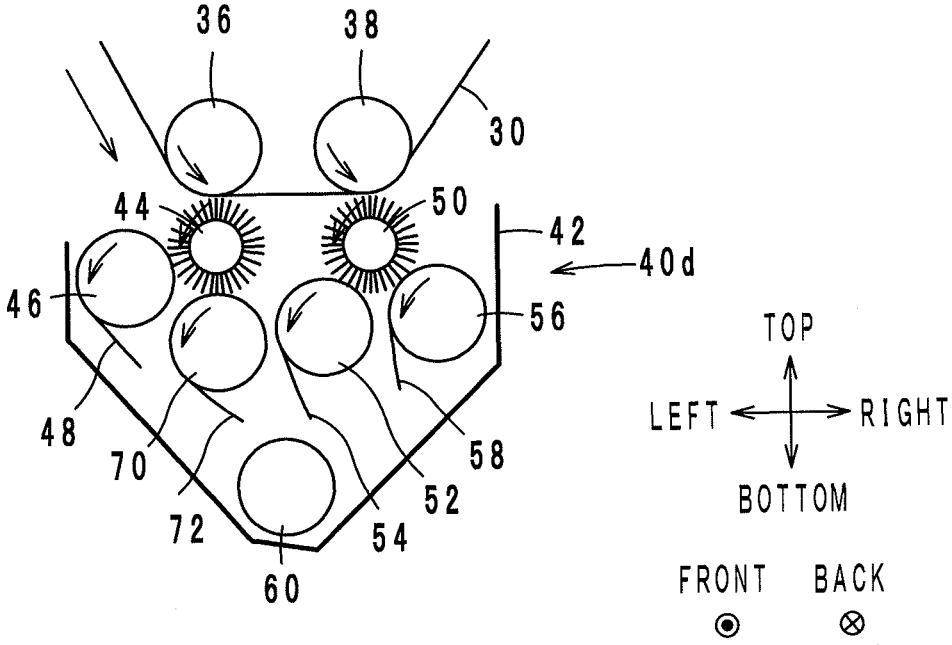
FIG. 9 is a configuration diagram of a cleaning device according to a fourth modification.

A cleaning device 40*d* according to a fourth modification will be described below with reference to the drawings. FIG. 9 is a configuration diagram of the cleaning device 40*d* according to the fourth modification.

The cleaning device 40*d* differs from the cleaning device 40 in that it further includes a collection roller 70 and a scraper 72.

The collection roller 70 is positioned downstream from the collection roller 46 in the toner collecting direction of the cleaning brush 44, and collects toner removed by the cleaning brush 44, as shown in FIG. 9. More specifically, the collection roller 70 rotates counterclockwise while contacting the bottom right of the cleaning brush 44, as shown in FIG. 9. The collection roller 70 bites into the cleaning brush 44. The amount of bite in the cleaning brush 44 by the collection roller 70 is approximately equal to the amount of bite in the cleaning brush 44 by the collection roller 46. The collection roller 70 is kept at a negative potential V6 through voltage application by an unillustrated power source. As a result, the potential difference of the collection roller 70 relative to the cleaning brush 44 (V6−V1) is opposite in polarity to the potential difference of the collection roller 46 relative to the cleaning brush 44 (V2−V1). Accordingly, the positively charged toner adhering to the cleaning brush 44 is collected by the collection roller 70. Then, the collected positively charged toner is separated from the circumferential surface of the collecting roller 70 by the scraper 72. As a result, the positively charged toner is stored to the housing 42.

In the cleaning device 40*d* thus configured, toner having been positively charged due to discharge between the cleaning brush 44 and the collection roller 46 is collected by the cleaning brush 50 and the collection rollers 52 and 56 and also collected by the collection roller 70. Thus, it is possible to more effectively inhibit oppositely charged toner from readhering to the belt 30.

To clarify effects achieved by the cleaning device 40*d*, the present inventors conducted a second experiment as will be described below.

The present inventors prepared a second example with the configuration shown in FIG. 9. Except that the potential V6 of the collection roller 70 is −800V, the conditions for the second example are the same as those for the first example, and therefore, any descriptions thereof will be omitted.

Figure 10:
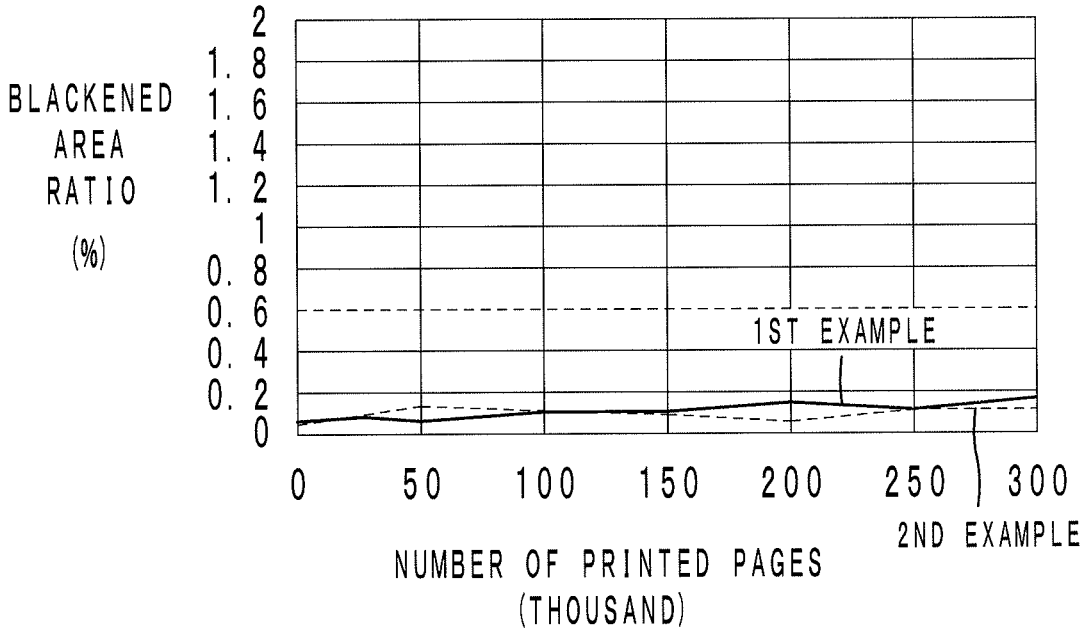
FIG. 10 is a graph showing the result of an experiment.

In the second example, a stabilizing toner patch formed on the intermediate transfer belt 11 between every two sheets was transferred onto the belt 30 through application of a secondary transfer voltage, and the stabilizing toner patch was collected by the cleaning device 40. In this case, 98% of the toner in the stabilizing patch on the intermediate transfer belt 11 moved to the belt 30. The stabilizing patch was formed between every two sheets, sequentially in one of the four colors: Y, M, C, and K. For each color, the amount of adhering toner in the stabilizing patch was 5 $g/m^2$. For each color, the stabilizing patch was a solid image having a maximum axial width and a length of 42 mm (10% of the length of an A3 size image) in the sheet feeding direction. Toner stains on the back of 300,000 printed sheets were inspected. The inspection of the toner stains on the back of the sheets was conducted by measuring the blackened area ratio. Specifically, the blackened area ratio is the percentage of a black area that occupies the back of a sheet in a captured image binarized by image processing. FIG. 10 is a graph showing the result of the experiment. The vertical axis represents the blackened area ratio, and the horizontal axis represents the number of printed pages.

For the second example, the blackened area ratio was further reduced compared to the first example, as shown in FIG. 10. Thus, it can be appreciated that the cleaning device 40*d* more effectively inhibited oppositely charged toner from readhering to the belt 30.

Fifth Modification

Figure 11:
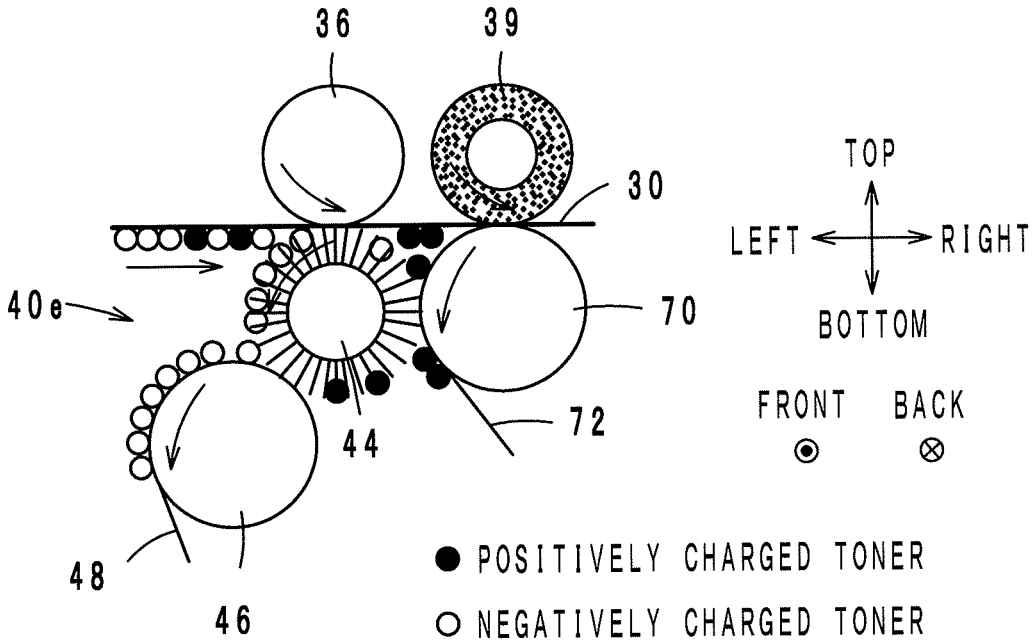
FIG. 11 is an enlarged view of a cleaning brush and its vicinity in a cleaning device according to a fifth modification.

A cleaning device 40*e* according to a fifth modification will be described below with reference to the drawings. FIG. 11 is an enlarged view of the cleaning brush 44 and its vicinity in the cleaning device 40*e* according to the fifth modification.

The cleaning device 40*e* differs from the cleaning device 40*d* in that it further includes a roller 39, the collection roller 70 is in contact with the belt 30, and none of the roller 38, the cleaning brush 50, the collection rollers 52 and 56 and the scrapers 54 and 58 is provided. Other components of the cleaning device 40*e* are the same as in the cleaning device 40*d*. The roller 39 of the cleaning device 40*e* includes an elastic layer of urethane foam, and is provided so as to be opposed to the collection roller 70 with respect to the belt 30 and pressed to the collection roller 70 under constant pressure. Note that the cleaning brush 44 of the cleaning device 40*e* corresponds to a first cleaning member.

Incidentally, the collection roller 46 is kept at a positive potential V2, which is higher than the potential V1 of the cleaning brush 44. Accordingly, some of the negatively charged toner is changed into positively charged toner due to discharge which occurs between the collection roller 46 and the cleaning brush 44. Such positively charged toner on the cleaning brush 44 is not collected by the collection roller 46. Therefore, the positively charged toner is carried on the cleaning brush 44, downstream in the toner collecting direction.

The collection roller 70 is positioned downstream from the collection roller 46 in the toner collecting direction of the cleaning brush 44, and collects toner removed by the cleaning brush 44, as shown in FIG. 11. More specifically, the collection roller 70 is positioned to the right of the cleaning brush 44, and rotates counterclockwise while contacting the cleaning brush 44 and the belt 30, as shown in FIG. 11. The collection roller 70 bites into the cleaning brush 44. The amount of bite in the cleaning brush 44 by the collection roller 70 is approximately equal to the amount of bite in the cleaning brush 44 by the collection roller 46. The collection roller 70 is kept at a negative potential V6 through voltage application by an unillustrated power source. As a result, the potential difference of the collection roller 70 relative to the cleaning brush 44 (V6−V1) is opposite in polarity to the potential difference of the collection roller 46 relative to the cleaning brush 44 (V2−V1). Accordingly, the positively charged toner adhering to the cleaning brush 44 is collected by the collection roller 70. Then, the collected positively charged toner is separated from the circumferential surface of the collecting roller 70 by the scraper 72. As a result, the positively charged toner is stored to the housing 42.

Furthermore, the collection roller 70 is kept at a negative potential, and is in contact with the belt 30. Accordingly, the collection roller 70 collects positively charged toner that has been carried on the belt 30 without being collected by the cleaning brush 44. The collected positively charged toner is separated from the circumferential surface of the collecting roller 70 by the scraper 72. As a result, the positively charged toner is stored to the housing 42.

The collection roller 70 is an aluminum roller coated with polyimide provided with conductivity by dispersing carbons therein. That is, the collection roller 70 has a semiconductive surface layer. The collection roller 70 has a resistance value of $10^8\Omega$.

The cleaning device 40*e* thus configured also makes it possible to inhibit positively charged toner from readhering to the belt 30.

Furthermore, the cleaning device 40*e* eliminates the need for the cleaning brush 50, the collection rollers 52 and 56, and the scrapers 54 and 58, leading to a reduction in device size.

To clarify effects achieved by the cleaning device 40*e*, the present inventors conducted a third experiment as will be described below.

Conditions for the third example will be described below.

Conditions for the third example:

Potential V1 of cleaning brush 44: 200V;

Potential V2 of collection roller 46: 800V;

Potential V6 of collection roller 70: −600V;

Circumferential speed of cleaning brush 44: 250 mm/sec;

Circumferential speed of collection roller 46: 400 mm/sec;

Circumferential speed of collection roller 70: 250 mm/sec;

Sheet feed speed: 500 mm/sec;

Amount of bite in cleaning brush 44 by belt 30: 1.4 mm;

Amount of bite in cleaning brush 44 by collection rollers 46 and 70: 1.4 mm;

Total pressure load of collection roller 70 on roller 39: 5 newtons [N];

Toner: negatively charged toner obtained by treating 100 parts by weight of a toner base material, produced by wet granulation and having a mean volume diameter of about 6.5 μm, with an additive containing 0.2 parts by weight of a first hydrophobic silica, 0.5 parts by weight of a second hydrophobic silica, and 0.5 parts by weight of a hydrophobic titanium oxide;

Sheet: coated paper with smooth surface and high transferability.

Figure 12:
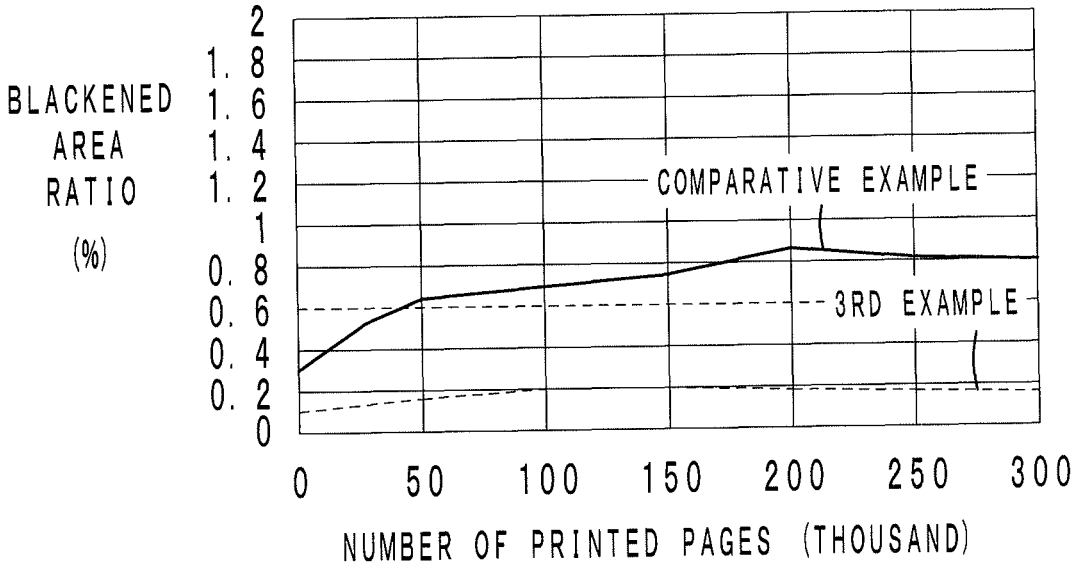
FIG. 12 is a graph showing the result of an experiment.

In the third example, a stabilizing toner patch formed on the intermediate transfer belt 11 between every two sheets was transferred onto the belt 30 through application of a secondary transfer voltage, and the stabilizing toner patch was collected by the cleaning device 40. In this case, 98% of the toner in the stabilizing patch on the intermediate transfer belt 11 moved to the belt 30. The stabilizing patch was formed between every two sheets, sequentially in one of the four colors: Y, M, C, and K. For each color, the amount of adhering toner in the stabilizing patch was 5 g/m$^2$. For each color, the stabilizing patch was a solid image having a maximum axial width and a length of 21 mm (5% of the length of an A3 size image) in the sheet feeding direction. Toner stains on the back of 300,000 printed sheets were inspected. The inspection of the toner stains on the back of the sheets was conducted by measuring the blackened area ratio. Specifically, the blackened area ratio is the percentage of a black area that occupies the back of a sheet in a captured image binarized by image processing. FIG. 12 is a graph showing the result of the experiment. The vertical axis represents the blackened area ratio, and the horizontal axis represents the number of printed pages.

For the third example, the blackened area ratio was reduced compared to the comparative example, as shown in FIG. 12. Thus, it can be appreciated that the cleaning device 40*e* inhibited oppositely charged toner from readhering to the belt 30.

Sixth Modification

Figure 13:
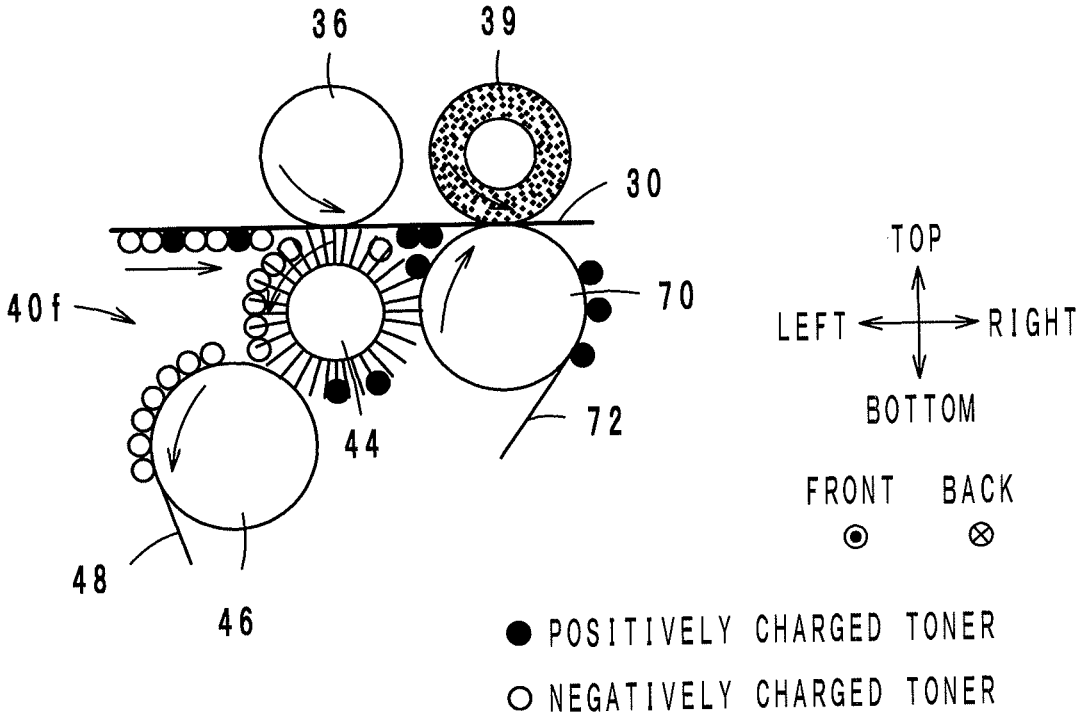
FIG. 13 is an enlarged view of a cleaning brush and its vicinity in a cleaning device according to a sixth modification.

A cleaning device 40*f* according to a sixth modification will be described below with reference to the drawings. FIG. 13 is an enlarged view of the cleaning brush 44 and its vicinity in the cleaning device 40*f* according to the sixth modification.

The cleaning device 40*f* differs from the cleaning device 40*e* in terms of the rotational direction of the collection roller 70 and the position where the scraper 72 contacts the collection roller 70. In the cleaning device 40*f*, the collection roller 70 rotates clockwise, and the scraper 72 contacts the bottom right of the collection roller 70, thereby separating toner from the circumferential surface of the collection roller 70.

Although the collection roller 70 rotates clockwise as shown in FIG. 13, the cleaning device 40*f* can achieve effects similar to those achieved by the cleaning device 40*e*.

Seventh Modification

Figure 14:
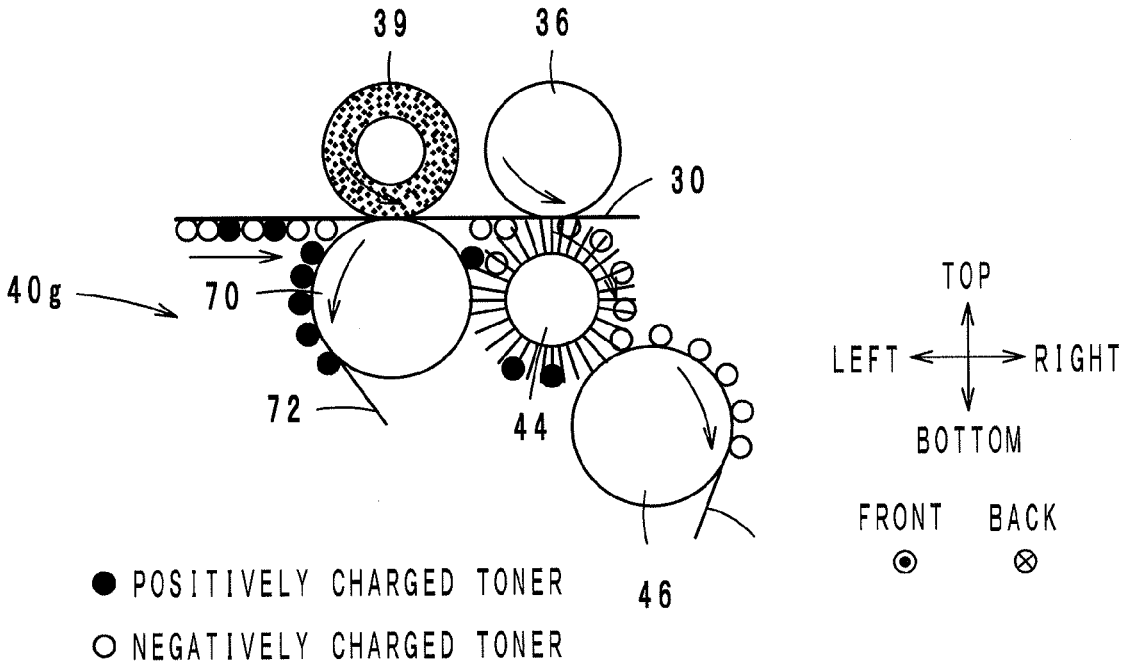
FIG. 14 is an enlarged view of a cleaning brush and its vicinity in a cleaning device according to a seventh modification.

A cleaning device 40*g* according to a seventh modification will be described below with reference to the drawings. FIG. 14 is an enlarged view of the cleaning brush 44 and its vicinity in the cleaning device 40*g* according to the seventh modification.

The cleaning device 40*g* differs from the cleaning device 40*e* in terms of the rotational directions of the cleaning brush 44 and the collection roller 46, the positions of the collection rollers 46 and 70, the positions of the rollers 36 and 39, the positions of the scrapers 48 and 72, and the positions where the scrapers 48 and 72 contact the collection rollers 46 and 70. In the cleaning device 40*g*, the cleaning brush 44 and the collection roller 46 rotate clockwise. The collection roller 46 is provided to the bottom right of the cleaning brush 44. The collection roller 70 is provided to the bottom left of the cleaning brush 44 (on the downstream side from the collection roller 46 in the toner collecting direction). The roller 36 is opposed to the cleaning brush 44 with respect to the belt 30. The roller 39 is positioned to the left of the roller 36, and opposed to the collection roller 70 with respect to the belt 30. The scraper 48 contacts the bottom right of the collection roller 46, and the scraper 72 contacts the bottom right of the collection roller 70.

Although the cleaning brush 44 and the collection roller 46 rotate clockwise as shown in FIG. 14, the cleaning device 40*g* can achieve effects similar to those achieved by the cleaning device 40*e*.

Eighth Modification

Figure 15:
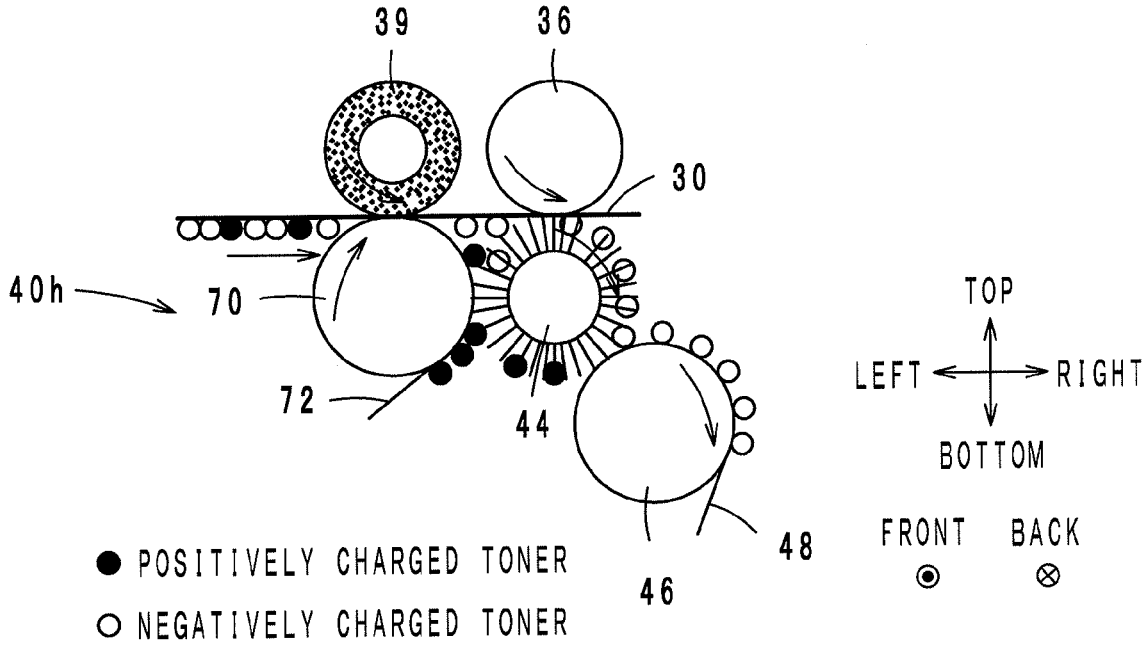
FIG. 15 is an enlarged view of a cleaning brush and its vicinity in a cleaning device according to an eighth modification.
Figure 16:
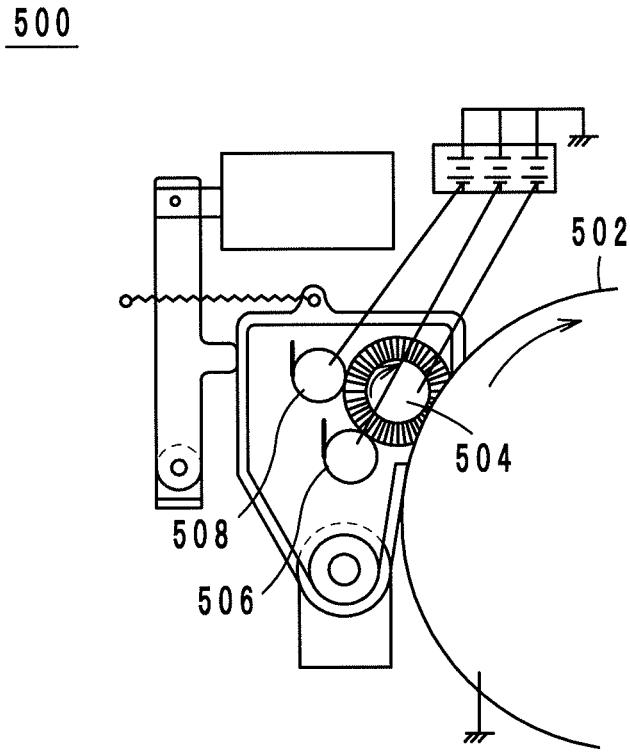
FIG. 16 is a configuration diagram of a multicolor image recording device described in Japanese Patent Laid-Open Publication No. 1989-307772.

A cleaning device 40*h* according to an eighth modification will be described below with reference to the drawings. FIG. 15 is an enlarged view of the cleaning brush 44 and its vicinity in the cleaning device 40*h* according to the eighth modification.

The cleaning device 40*h* differs from the cleaning device 40*e* in terms of the rotational directions of the cleaning brush 44 and the collection rollers 46 and 70, the positions of the collection rollers 46 and 70, the positions of the rollers 36 and 39, the positions of the scrapers 48 and 72, and the positions where the scrapers 48 and 72 contact the collection rollers 46 and 70. In the cleaning device 40*h*, the cleaning brush 44 and the collection rollers 46 and 70 rotate clockwise. The collection roller 46 is provided to the bottom right of the cleaning brush 44. The collection roller 70 is provided to the bottom left of the cleaning brush 50 (on the downstream side from the collection roller 46 in the toner collecting direction). The roller 36 is opposed to the cleaning brush 44 with respect to the belt 30. The roller 39 is positioned to the left of the roller 36, and opposed to the collection roller 70 with respect to the belt 30. The scraper 48 contacts the bottom right of the collection roller 46, and the scraper 72 contacts the bottom right of the collection roller 70.

Although the cleaning brush 44 and the collection rollers 46 and 70 rotate clockwise as shown in FIG. 15, the cleaning device 40*h* can achieve effects similar to those achieved by the cleaning device 40*e*.

Other Embodiments

The present invention is not limited to the cleaning devices 40 and 40*a* to 40*h*, and variations can be made within the sprit of the invention.

Note that the target to be cleaned by the cleaning devices 40, and 40*a* to 40*h* is not limited to the belt 30, and the intermediate transfer belt 11 or the photoreceptor drum 4 may be cleaned. That is, the target to be cleaned can be any rotating body having a circumferential surface to which toner adheres.

Although the present invention has been described in connection with the preferred embodiment above, it is to be noted that various changes and modifications are possible to those who are skilled in the art. Such changes and modifications are to be understood as being within the scope of the invention.

What is claimed is:

1. A cleaning device for cleaning a cleaning subject, comprising:

a first cleaning member that rotates in a predetermined direction, thereby removing toner from the cleaning subject;

a first collecting member that collects the toner removed by the first cleaning member; and a second collecting member that is positioned downstream from the first collecting member in the predetermined direction and collects the toner removed by the first cleaning member, wherein, a potential difference of the first collecting member relative to the first cleaning member is opposite in polarity to a potential difference of the second collecting member relative to the first cleaning member, the first collecting member has a potential equal in polarity to that of the first cleaning member, and the potential of the first collecting member is greater in magnitude than the potential of the first cleaning member.

2. The cleaning device according to claim 1, further comprising a second cleaning member that is positioned upstream from the first cleaning member in a moving direction of the cleaning subject and removes toner from the cleaning subject, wherein, the first cleaning member has a potential opposite in polarity to that of the second cleaning member.

3. The cleaning device according to claim 2, wherein, toner adhering to the cleaning subject in an area upstream from the second cleaning member in the moving direction of the cleaning subject, includes toner charged with a first polarity and toner charged with a second polarity, the amount of the toner charged with the second polarity is less than the amount of the toner charged with the first polarity, the potential of the first cleaning member has the first polarity, and the potential of the second cleaning member has the second polarity.

4. The cleaning device according to claim 1, wherein, toner adhering to the cleaning subject in an area upstream from the first cleaning member in the moving direction of the cleaning subject, includes toner charged with a first polarity and toner charged with a second polarity the amount of the toner charged with the second polarity is less than the amount of the toner charged with the first polarity, and the potential of the first cleaning member has the second polarity.

5. The cleaning device according to claim 4, wherein the second collecting member contacts the cleaning subject, thereby collecting toner from the cleaning subject.

6. The cleaning device according to claim 1, wherein the second collecting member has a semiconductive surface layer.

7. The cleaning device according to claim 1, wherein the first collecting member is a brush.

8. The cleaning device according to claim 1 wherein the potential of he first collecting member is kept equal in polarity to that of the first cleaning member.

9. The cleaning device according to claim 1, wherein the potential difference of the first collecting member relative to the first cleaning member is kept opposite in polarity to the potential difference of the second collecting member relative to the first cleaning member.

* * * * *